US005676377A

United States Patent [19]

Lynn, Jr. et al.

[11] Patent Number: 5,676,377

[45] Date of Patent: Oct. 14, 1997

[54] BIODIGESTIBLE COLD-PRESSED SKEET TARGET

[76] Inventors: Arthur E. Lynn, Jr., Rte. 7, Box 218-A, Andalusia, Ala. 36420; Lynda L. Barco, 2571 E. Holly Point Rd., Orange Park, Fla. 32073

[21] Appl. No.: 780,961

[22] Filed: Jan. 10, 1997

Related U.S. Application Data

[63] Continuation of Ser. No. 597,934, Feb. 7, 1996, abandoned.

[51] Int. Cl.[6] ..... F41J 9/16

[52] U.S. Cl. ..... 273/362

[58] Field of Search ..... 373/362–365; 426/62; 99/4

[56] References Cited

U.S. PATENT DOCUMENTS 1,369,830 3/1921 Mitchell .
3,359,001 12/1967 Silva .
3,640,081 2/1972 Hadden .
3,660,104 5/1972 Godbold ..... 99/4
4,357,358 11/1982 Schanze ..... 426/62
5,174,581 12/1992 Goodson .
5,316,313 5/1994 Moore .
5,467,998 11/1995 Hellings .

*Primary Examiner*—Mark S. Graham

[57] ABSTRACT

An improved frangible skeet target is provided. The skeet target has an aerodynamic structure and is constructed to retain structural integrity upon being thrown. The skeet target is biodigestible and comprised of finely ground food grains or seeds in a molasses binder cold pressed to form the hardened skeet target.

8 Claims, 1 Drawing Sheet

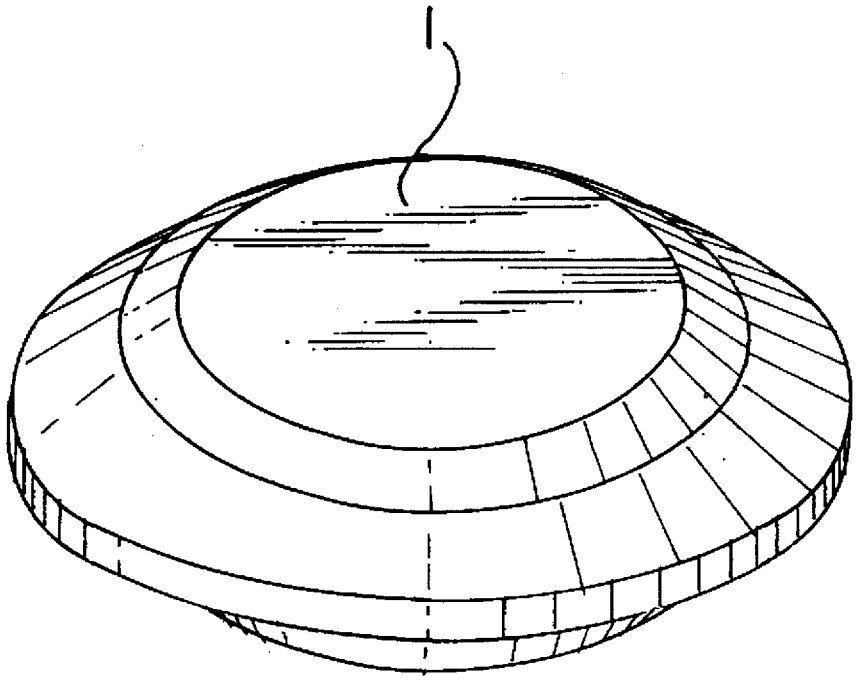
1

BIODIGESTIBLE COLD-PRESSED SKEET TARGET

This application is a continuation of application Ser. No. 08/597,934 filed Feb. 7, 1996, abandoned.

BACKGROUND OF THE PRESENT INVENTION

The present invention is directed to an improved biodigestible skeet target.

Conventionally, skeet targets are formed of clay and thrown into the air for target practice either by hand or by mechanical means. Such targets, upon being hit, disintegrate into a multitude of small non-biodegradable and non-biodigestible pieces and particles. The resulting non-biodegradable and non-biodigestible pieces and particles thus contaminate the environment and form a potential hazard for wildlife. The use of non-biodegradable and non-biodigestible skeet targets has been found to constitute an especially noxious hazard when used at sea by, for example, cruise lines or in wetlands.

It has accordingly been desirable to provide a more environmentally-acceptable material for use in the manufacture of skeet targets. By way of example, U.S. Pat. No. 5,316,313 discloses a clay pellet having a biodegradable binder. U.S. Pat. No. 5,174,581 discloses biodegradable clay target comprised of a matrix of crystallized sugar together with a plurality of substantially granular edible elements such as birdseed, oatmeal or legumes. U.S. Pat. No. 1,369,830 discloses a trap target filled with flour to ensure that a cloud of powder is formed upon hitting the target. U.S. Pat. No. 5,467,998 discloses a biodegradable skeet comprised of a baked admixture of flour and an edible element such as birdseed, corn, grain, rice, grass and wood.

However, despite the above, a need exists for a substantially completely biodigestible and edible skeet target which may be readily manufactured and is non-hazardous and non-polluting to the environment. A need also exists to provide a biodigestible skeet target which avoids the use of a sugar matrix material which is susceptible to breakage and which may become physically unstable in the presence of moisture.

In accordance with the present invention, there is thus provided a skeet target having an aerodynamic structure and constructed to retain structural integrity upon being thrown, the improvement wherein said skeet target is biodigestible and comprised of ground food grains or seeds in a molasses binder cold pressed to form the hardened skeet target.

BRIEF DESCRIPTION OF THE DRAWING

The FIGURE is a view in perspective of a skeet that may be produced according to the present invention.

DETAILED DESCRIPTION OF THE PRESENT INVENTION

It is the intent of the present invention to provide a skeet target which avoids completely the use of clay or similar non-biodegradable and non-edible ceramic materials. It is instead the intent to provide a skeet target which is completely biodigestible and edible, as well as non-polluting to the environment.

The skeet target 1 of the present invention has, for example, the configuration depicted in the FIGURE having an aerodynamic structure which permits the skeet to be projected into the air. The skeet is comprised of a hardened admixture of ground food grains or seeds in a molasses binder.

The ground food grains or seeds may take a variety of forms and be comprised of a variety of grains or seeds. The ground food grain or seed may take the form of cereal grain flour or meal or other edible grain or seed flour or meal. By way of example, suitable flours or meals may be formed from corn, wheat, oats, barley, rice, soybeans, cottonseeds, etc. This list is not all-inclusive and one skilled in the art can readily identify acceptable biodigestible and edible food grains and seeds which may be used to form a ground flour or meal for use in the present invention. Soybean meal is the preferred meal for use in the present invention in order to enhance the protein content of the target.

The ground flour or meal is preferably present in the amount of from about 95 to 99% by weight, based on the total weight of the composition.

The particle size of the ground food grain or seeds is not critical. The presence of the more granulated meal component assists in increasing the bulk density of the target, while also assisting in causing the target to break apart during use. Preferably, the flour component, if present, is present in an amount of up to 25 percent by weight of the total weight of the target.

Molasses is the second component used in connection with the present invention. The molasses component serves as a binder for the ground food grain or seed upon cold pressing of the admixture. The molasses component is preferably present in an amount in the range of from about 1 to 5% by weight, based on the total weight of the composition.

The product of the present invention may be simply produced. A mixture of the ground flour or meal and molasses is formed. The molasses is combined with the ground flour or meal in an amount sufficient to cause the flour or grain particles to bind or stick together, yet insufficient to result in a flowable admixture. Minor amounts of trace minerals (as nutrition enhancers) and/or coloring agents may be added at this time as desired. The resulting mixture is then poured or injected into a suitably-shaped mold (in the shape of a skeet target of appropriate size) and cold pressed in a hydraulic press at sufficient pressure and for a time to form a hardened skeet target. The resulting product will have sufficient structural integrity to serve as a skeet target, as well as to survive the rigors of packing and shipping. By way of example, hydraulic mold pressures on the order of 20 tons are suitable.

As skeet targets must be of standard sizes and weights, the type and amounts of the components used to produce the skeet target may be varied to produce a target having the desired weight and size. For instance, in order to produce a skeet target having a reduced weight on a density basis (#/ft$^3$), a cereal grain flour (such as wheat flour) may be present in an amount of, for example, up to about 25% by weight. As the flour component is of lesser density than a meal component, a skeet target is produced which has a lessened weight in comparison to a skeet target formed entirely of a heavier meal component. Also, the surface texture of the skeet target may be made smoother by the addition of a cereal grain flour.

EXAMPLE

An admixture of the following components is formed:

soybean meal 8 oz wheat flour 1½ oz molasses ½ oz

By way of alternative description, a suitable composition used to produce a skeet target of the present invention includes 1 cup soybean meal, ¼ cup cornmeal ⅛ cup trace minerals, ⅛ cup wheat flour, together with sufficient molasses to form an admixture in which the components are bound together.

The admixture is placed into a suitable skeet target mold and cold pressed in a hydraulic press at high pressure. The target is removed from the mold in a hardened form and is suitable for use as a skeet target.

The resulting target may be used with success in skeet shooting. Upon being hit, the target will readily break apart to provide edible biodegradable particles having nutritional value to wildlife, either at sea or on land. The resulting particles will also degrade or disintegrate within a few days under ambient conditions of the outdoors.

What is claimed is:

1. In a frangible skeet target having an aerodynamic disc-shaped structure adapted to be fitted to a conventional skeet launcher and constructed to retain structural integrity upon being thrown, the improvement wherein said skeet target is biodigestible and comprised of a hardened cold-pressed admixture of ground food grains or seeds in a molasses binder.

2. The target of claim 1 wherein said ground food grains or seeds comprises a cereal grain meal derived from a cereal grain selected from the group consisting of corn, wheat, rice, barley and oats.

3. The target of claim 1 wherein said ground food grains or seeds comprises soybean meal.

4. The target of claim 1 wherein said ground food grains or seeds comprises cottonseed meal.

5. The target of claim 1 wherein said ground food grains or seeds comprises cornmeal.

6. The target of claim 1 wherein said molasses component comprises from 1 to 5 percent by weight of said target.

7. The target of claim 1 wherein said ground food grains or seeds include cereal grain flour in an amount of up to 25% by weight.

8. The target of claim 1 further comprising trace minerals.

* * * * *